US005114391A

United States Patent [19]

Pitzen et al.

[11] Patent Number: 5,114,391

[45] Date of Patent: May 19, 1992

[54] UPPER AND LOWER BODY EXERCISER

[75] Inventors: Gerald Pitzen, Arden Hills; Douglas Garfield, Northfield; Warren G. Beltz; Lawrence O. Arntzen, both of St. Paul; Joseph C. Bina, Oakdale, all of Minn.

[73] Assignee: Bioform Engineering, Inc., Ross, Calif.

[21] Appl. No.: 520,075

[22] Filed: May 7, 1990

Related U.S. Application Data

[62] Division of Ser. No. 252,169, Sep. 30, 1988, Pat. No. 4,923,193.

[51] Int. Cl.[5] ..... A63B 21/00; A63B 21/005

[52] U.S. Cl. ..... 482/62; 482/72; 482/2

[58] Field of Search ..... 272/72, 73, 129, 128; 128/25 R; 74/20–25

[56] References Cited

U.S. PATENT DOCUMENTS

| | | | |
|---|---|---|---|
| 305,198 | 9/1884 | Kempster . | |
| D. 306,892 | 3/1990 | Pitzen et al. | D21/194 |
| 968,355 | 8/1910 | Hopkins | 280/241 |
| 1,273,079 | 7/1918 | Matson . | |
| 1,412,276 | 4/1922 | Dahl . | |
| 3,134,378 | 5/1964 | Harwood | 128/25 |
| 3,877,724 | 4/1975 | Chase | 280/241 |
| 3,891,235 | 6/1975 | Shelly | 280/252 |
| 4,169,609 | 10/1979 | Zampedro | 280/241 |
| 4,188,030 | 2/1980 | Hooper | 272/73 |
| 4,508,358 | 4/1985 | Erel | 280/234 |
| 4,618,141 | 10/1986 | Ashworth | 272/73 |
| 4,729,559 | 3/1988 | McNeil | 272/73 |
| 4,757,988 | 7/1988 | Szymski | 272/73 |
| 4,762,317 | 8/1988 | Camfield et al. | 272/73 |
| 4,832,332 | 5/1989 | Dumbser | 272/72 |
| 4,867,447 | 9/1989 | Johnson | 272/72 |
| 4,923,193 | 5/1990 | Pitzen et al. | 272/73 |

*Primary Examiner*—Stephen R. Crow
*Attorney, Agent, or Firm*—Kinney & Lange

[57] ABSTRACT

Disclosed is an exercise device providing mechanical actions for independent or simultaneous exercise of the upper and lower body of a human user. Each action incorporates a mechanical movement converting output of the user to rotational motion and thereby powering one of two electrical generators. An exercise controller selects loads to be applied to the generators. The loads are coupled by the mechanical movements back to the user to provide resistance to the exercise effort. The exercise controller drives an electronic display which informs the user of his or her intensity of effort as well as the proportion of that effort being met through exercise of the upper body and the part being met through exercise of the lower body.

13 Claims, 4 Drawing Sheets

UPPER AND LOWER BODY EXERCISER

This is a division of application Ser. No. 07/252,169, filed Sep. 30, 1988, now U.S. Pat. No. 4,923,193.

BACKGROUND OF THE INVENTION

1. Field of the Invention

The invention relates to an apparatus for human physical exercise, and, more particularly, to an apparatus suitable for simultaneous upper and lower body exercise and providing for workload distribution between the body parts.

2. Description of the Prior Art

A variety of stationary exercise machines are known to the art. Examples of such machines include stationary rowing machines and stationary bicycles. These machines typically simulate a common human activity, such as rowing or bicycling. They lack somewhat in adaptability to specialized exercise needs, and in flexibility to accommodate properly to the physical size of the user.

Rowing, for example, is usually a combined upper and lower body exercise, especially where a sliding seat is provided for the rower. Rowing absorbs work from a large muscle mass, including the major muscles of the arms, torso and legs, in a bilaterally symmetrical, rhythmic pattern of movement. A bilaterally symmetric pattern of movement is one that is identical and simultaneous between the sides of the body. Rowing is generally considered to be an excellent exercise, both for cardiovascular benefits as well as overall conditioning. However, rowing has disadvantages for some individuals, such as patients undergoing rehabilitative therapy, who cannot match the range of movement required by the exercise. The rigid definition of the rowing movement does not allow the exerciser to change muscle sets to meet the total intensity level required or to compensate for limited mobility in certain joints.

Another disadvantage of rowing is a high perceived effort required to achieve a given workout intensity level. This high perceived effort results from a number of factors. Rowing imposes an extreme hip and torso flexion at the beginning of each power stroke. The extreme flexion increases intrathoracic pressures which affect cardiac output and make breathing more difficult. Moreover, the workload is imposed in an on and off pattern, on during the expanding power stroke and off during the relaxation phase. The portion of the total workload concentrated in the power strokes is thus large. In addition, rowing imposes a substantial amount of lower back stress on the user.

Stationary bicycles avoid the stop and start sensation of a rowing machine. However, stationary bicycles have their own disadvantages. Cycling does not distribute the workload, but confines it to the leg muscles. Obviously, the user cannot change muscle sets or the pattern of the exercise and maintain the same overall intensity of exercise. Also, stationary bicycles have typically used perch type seats, influenced by conventional safety bicycles, as an exercise position. This position is not usually comfortable to the infrequent cyclist, and tends to contribute to a feeling of instability on the machines. The perch type saddle contributes to saddle sores and to a relative lack of stability in a nonmoving bicycle.

A handful of prior art devices have attempted to combine a rowing or other type of upper body exercise with a cycling exercise. One prior art device, taught in U.S. Pat. No. 4,188,030, issued Feb. 12, 1980, provides a stationary bicycle with a pair of exercise arms which are linked to the mechanical movement of the cycling exercise. A user can employ the arms or the cycling pedals to drive the movement. Resistance is applied to the movement to increase the workload. However, linkage of the mechanical movements rigidly defines the range of movement of the exercises. In addition, the device taught is substantially a conventional stationary bicycle which has exercise arms. It retains the perch position common to conventional exercise cycles.

Another prior art device is taught in U.S. Pat. No. 4,729,559, issued on Mar. 8, 1988. It includes exercise arms which are mechanically independent of a cycling exercise. However, the device does not include a way of determining the workload distributed between the cycling exercise and the upper body exercise. The device retains perch type seating common to other stationary bicycles.

Exercise, when appropriately administered, can elicit any one, or a combination, of many beneficial effects. These effects include increased cardiovascular efficiency and endurance, muscle strength and tone, and control of weight. Three different and qualifiable measurements of an individual's exercise may be made which relate to attaining the beneficial effects. These include a measurement of intensity comprising the level of power output of the individual, duration of an individual's bout of exercise and frequency of bouts of exercise. Intensity and duration may be used as factors in a calculation of total work done or energy expended in a particular bout, i.e., calories expended. The above noted benefits are enjoyed only when exercise is persisted in at appropriate intensity levels. The present invention is directed to maintaining a higher degree of perceived comfort and ease, and contributing to greater exercise frequency, while guiding the user in maintaining an appropriate level of intensity in individual bouts.

SUMMARY OF THE INVENTION

The exerciser of the present invention provides a cycling action for exercise of the lower body and a pair of exercise arms for upper body exercise. By providing for upper and lower body exercise, the workload on the user is distributed over a large number of muscle groups and muscle actions. Moreover, the upper body exercise of the present invention is more than a rowing exercise in the sense that it is not limited to a bilaterally symmetrical pattern of movement as described above. The mechanical movements of the present invention are adapted to apply resistance to each of the pair of exercise arms in both directions of movement. The arms may be moved entirely independently of one another, and may be moved for only a fraction of their overall travel. The mechanical movement allows two additional arm and torso exercises. The first additional exercise is termed "unilateral reciprocation" and involves moving the arms oppositely in a rhythmical pattern. The second additional exercise is termed "independent unilateral movement", where no particular relationship exists between movements of the arm and, in fact, one arm may remain motionless.

An important advantage of the present invention is an adjustable recumbent seating position. The user's reclined position provided by the recumbent seat reduces the adverse effects of gravity and posture on venous blood return. This reduces blood pressure during exercise, which is an important consideration for individuals in cardiac rehabilitation programs and also contributes to a lower level of perceived exertion. The recumbent position provides the user with a comfortable position posturewise during the course of their exercise. The recumbent seat also opens the hip position of the user which reduces pressure on the diaphragm, leading to fuller, more comfortable breathing. The recumbent type seat also offers greater stability for a user than a perch type seating arrangement. Greater comfort and reduced perceived effort tend to contribute to greater duration and greater frequency of exercise.

The exercise machine of the present invention guides exercise at a plurality of intensity levels. The mechanical movements for the lower and upper body are adapted to drive independent electrical generators. Variable resistor banks are provided for applying loads across these generators. The user may select a program of exercise which sets the total load to be met and the proportion of the load to be met from the upper body and the lower body.

The exercise device of the present invention also provides for tachometers on the generators to allow determination of work expended and compares such expenditure output against targets to determine the intensity of the workout. The machine also times the workout. Simplification of maintenance is provided by powering the electronics from the generators. Thus the effort of the user powers the electronics.

The onboard computer uses the data gathered to run a display indicating to the user the intensity of the workout and the proportions of the workout being met by the upper body and the lower body. The readouts guide the user to an appropriate level of work. The work expended in each exercise is monitored and compared to targets. This directs distribution of the total effort between the major body parts, reducing the perceived total effort required.

The exercise machine accordingly allows exercise which is physically comparable to cross-country skiing. It allows the user to switch back and forth between muscle groups to meet the intensity level required and it varies the intensity level required from moment to moment.

DETAILED DESCRIPTION OF THE PREFERRED EMBODIMENT

Figure 1:
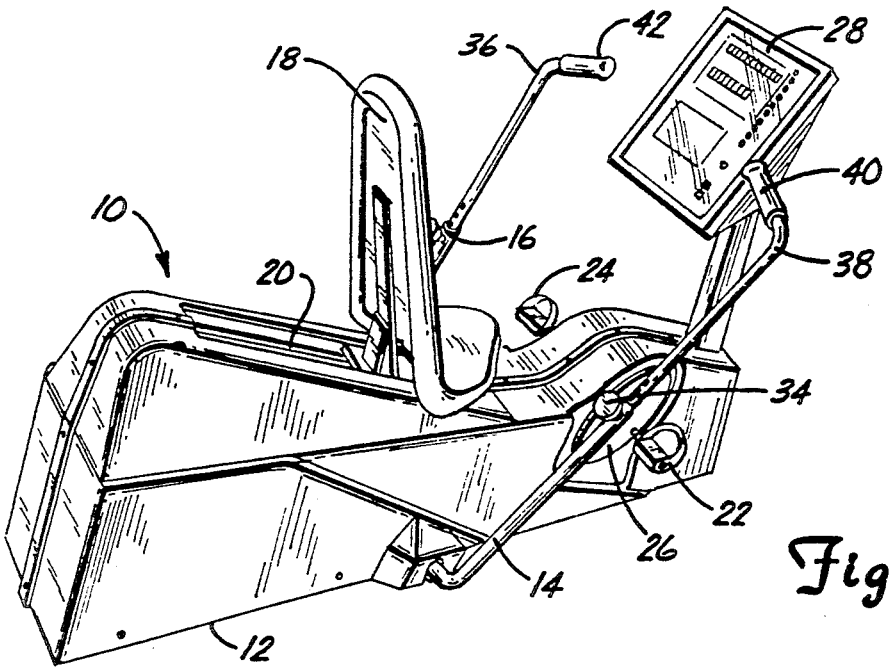
FIG. 1 is a perspective view of the exercise machine of the present invention.

FIG. 1 illustrates the external components of exercise machine 10 of the present invention. Exercise machine 10 includes an external body 12 which houses the mechanical movements of machine 10. An adjustable recumbent saddle 18 is mounted on a positioning track 20 to allow adjustment of the exercise position for a user. Recumbent saddle 18 is positioned by a user with respect to pedals 22 and 24 so as to enhance efficiency and comfort. Pedals 22 and 24 are mounted for rotation and are accessible to a user seated in recumbent saddle 18. Pedals 22 and 24 provide the cycling action of exercise machine 10.

A pair of exercise arms 14 and 16 are disposed on opposite sides of exercise machine 10, accessible to a user seated in recumbent saddle 18. Right exercise arm 14 includes an arm extension 38 which may be adjusted in height by adjustment knob 34. Hand grip 40 is provided for gripping by the user. Similarly, left exercise arm 16 includes an arm extension 36. Hand grip 42 for gripping by the user with his left hand is provided at the upper end of extension 36. An adjustment knob 32 (shown in FIG. 4) may be used to adjust the position of extension 36.

A user display and control panel 28 is provided for easy access and viewing by a user seated in recumbent saddle 18. User display and control panel 28 exhibits such information as exercise intensity level, proportion of intensity level being met, distribution of load between lower and upper body, terrain profile of the cycle exercise for lower body, estimated calories consumed and other information of interest to the user. Panel 28 also provides directions for changing the exercise program through control buttons accessible on the panel.

The position of recumbent saddle 18 is adjustable along track 20. Track 20 guides the positioning of recumbent saddle 18. This allows the long-legged user to adjust the saddle position to maintain the same open hip posture and body angle with respect to the cycling action. Recumbent saddle 18 supports body weight over a number of points and allows ease in mounting and dismounting exercise machine 10.

Figure 2:
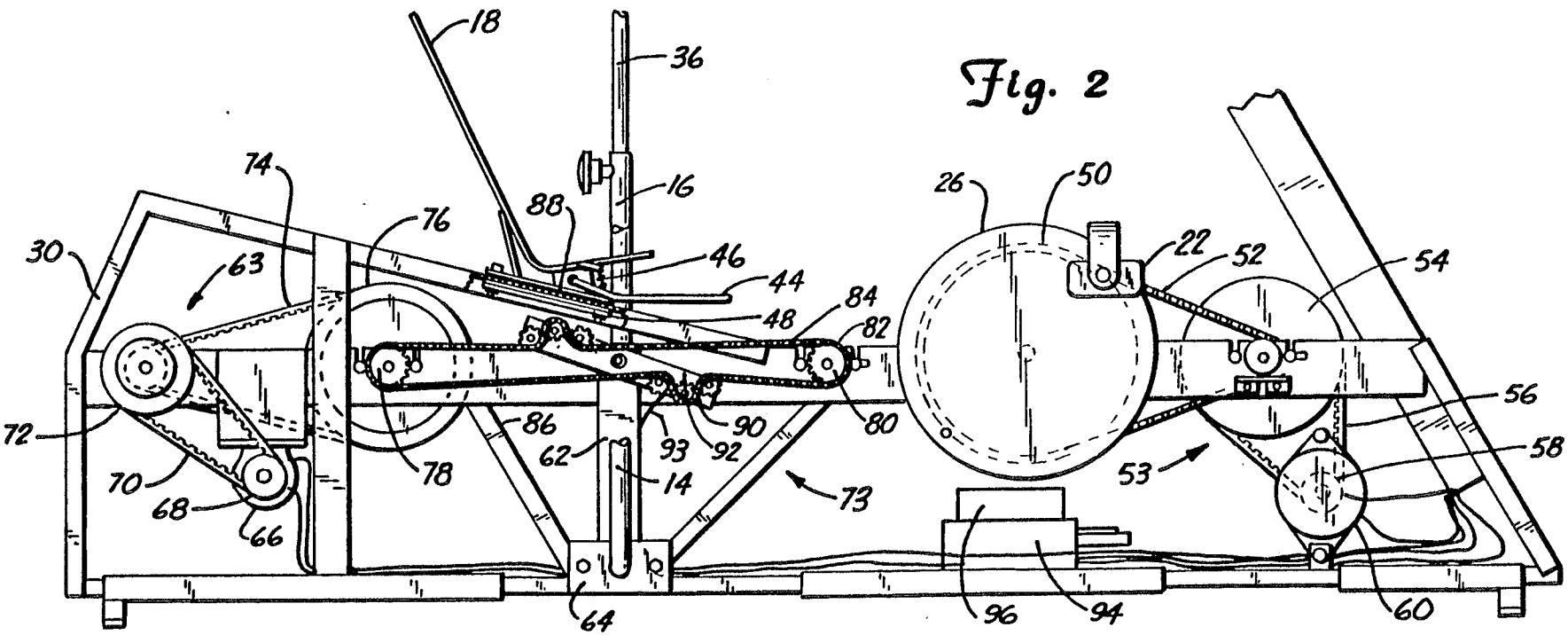
FIG. 2 is a cross sectional view of the mechanical movements of the present invention.

FIG. 2 illustrates the mechanical movements of the present invention. The mechanical movements include cycling drive train 53 and exercise arm drive train 63. Exercise arm drive train is 63 is mechanically coupled to two substantially identical translation to rotation mechanisms 73 and 77 (mechanism 77 being shown in part in FIG. 3). The description herein of mechanism 73 is exemplary of both mechanisms.

The exercise device of the present invention comprises a frame 30 adapted to support the exercise device on a surface. Cycling drive train 53 includes pedals 22 and 24 described in reference to FIG. 1, pedal 22 being visible in FIG. 2. Pedal 22 is pivotally mounted on disc 26, which is connected to drive crankset 50. Pedal 24 is similarly linked to drive crankset 50. Crank set 50 guides movement of the user's feet in a rotational direction to simulate bicycling. Crank set 50 is trained with an intermediate reduction gear 54 by chain 52. Intermediate reduction gear 54 is trained with a final drive gear 58 by chain 56. Final drive gear 58 is mounted on the axle to drive generator 60, which produces direct current electric power in response to movement of the cycling action.

Right translation to rotation mechanism 73 is disposed on the starboard side of frame 30. Mechanism 73 includes right exercise arm 14, which is linked to right inboard lever arm 62 on fulcrum 64 providing a lever actuated by a user.

Lever arm 62 supports an elongated clustered wheel carrier 92 for reciprocating movement. A tension spring 93 is linked between arm 62 and cluster wheel carrier 92 so as to pull cluster wheel carrier 92 toward vertical alignment with lever arm 62. Clustered wheel carrier 92 supports a pair of separated groups or clusters of sprockets 88 and 90. One cluster is designated the primary cluster 88 and the other cluster is designated the complementary cluster 90. The sprockets of clusters 88 and 90 comprise built-in Torrington-type clutches permitting rotation in one direction only. The three sprockets in each cluster are further disposed at the vertices of a regular triangle to engage a chain 82 on either side thereof.

Chain 82 trains drive gear 78 with idler gear 80. The upper chain lead between idler 80 and drive gear 78 is termed primary lead 84 of chain 82. Primary lead 84 is laced through primary sprocket cluster 88, passing under the two outboard sprockets and over the intermediary sprocket. The outboard sprockets are adapted to rotate freely clockwise. The intermediate sprocket rotates counterclockwise. Thus chain 82 passes freely in the direction of primary lead 84 from idler 80 to drive gear 78.

The lower chain lead between drive gear 78 and idler 80 is termed the complementary chain lead 86 of chain 82. Complementary lead 86 is laced on complementary sprocket cluster 92, passing over the outboard sprockets and under the intermediary sprocket. The outboard sprockets can rotate in the clockwise direction only, intermediary sprocket can rotate in the counterclockwise direction only. Thus chain 82 passes through the cluster in the direction of complementary lead 86 only, that is, from drive gear 78 to idler 80.

Reciprocating movement of cluster wheel carrier 92, without regard to initial direction, results in movement in a single direction of chain 80. Movement of carrier 92 toward drive gear 78 is termed the primary cycle. As the movement of carrier 92 in the primary cycle matches the velocity of chain 82 in primary lead 84, the sprockets of primary sprocket cluster 88 clutch and kinetic energy may be transferred through the sprockets to chain 82. As the speed of carrier 92 in the complementary cycle matches the velocity of chain 82 in complementary lead 86, the sprockets of complementary sprocket cluster 90 clutch and kinetic energy may be applied to chain 82 from lever rm 62. Movement of either sprocket against its respective lead results in the chain passing through the cluster without substantial hindrance.

The operation of rotation to translation mechanism 77 is substantially similar and is not elaborated on further here.

Reciprocating movement of cluster carrier 92 results in counterclockwise rotation of drive gear 78. This in turn puts drive train 63 into motion. Drive gear 78 is coupled to rotate crankset 76. A chain 74 trains crankset 76 to intermediate reduction gear 72. Intermediate reduction gear 72 is coupled to final drive pulley 68 by timing belt 70. Drive pulley 68 is linked to D.C. generator 66.

Accordingly, as exercise arm 14 is pulled toward a user seated in saddle 18, energy may be transferred from primary cluster 88 to chain 82 in primary lead 84. As exercise arm 14 is pushed away from a user seated in saddle 18, energy may be transferred from cluster set 90 to chain 82 in complementary lead 86. In either event, energy is transferred from the user to drive generator 66.

Recumbent saddle 18 is supported on a carriage 48 mounted on track 20. The position of carriage 48 on track 20 is locked by mechanism 46 which may be released for movement by lever 44. Also shown are a variable resistor pack 94 and heat sink 96, the operation of which is explained below.

Figure 3:
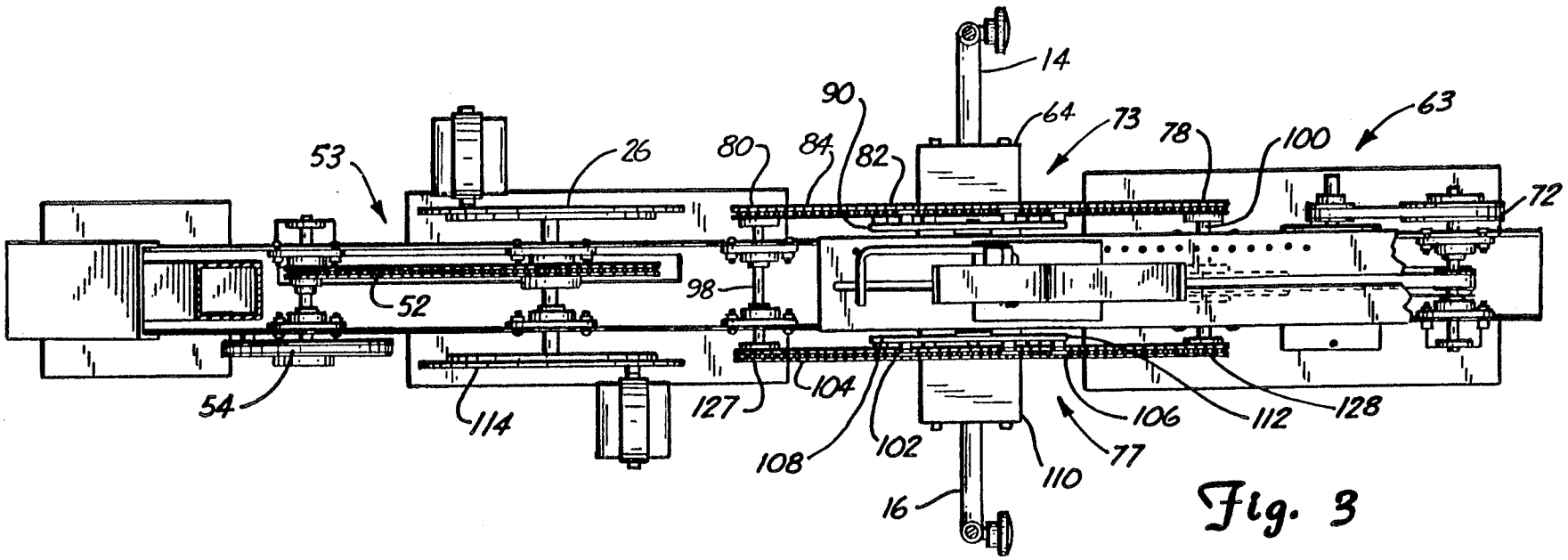
FIG. 3 is a top plan view of the mechanical movements of the present invention.

FIG. 3 is a top partial cutaway view of frame 30. A translation to rotation conversion movement 77 is provided on the port side of frame 30. Conversion movement 77 is substantially identical to movement 73 on the starboard side of exerciser 10. Left rowing arm 16 is part of a lever mounted on fulcrum 110. The lever includes an inboard lever arm (not shown) which supports cluster carrier 112. Cluster carrier 112 supports primary wheel cluster 106 and complementary wheel cluster 108 to engage left chain 102. Chain 102 trains idler gear 127 with drive gear 128. Idler wheel 127 is linked with idler wheel 80 by axle 98. Drive gear 128 is linked with drive gear 78 by axle 100. Axle 100 is a portion of a crankset 76 for driving drive chain 63. Linkage of the translational movements to rotational movements 73 and 77 permits arm exercises to be carried out with one arm only. Actuation of the movement by one arm will simply result in the chain associated with the opposite arm moving across its corresponding freewheeling clusters.

Figure 4:
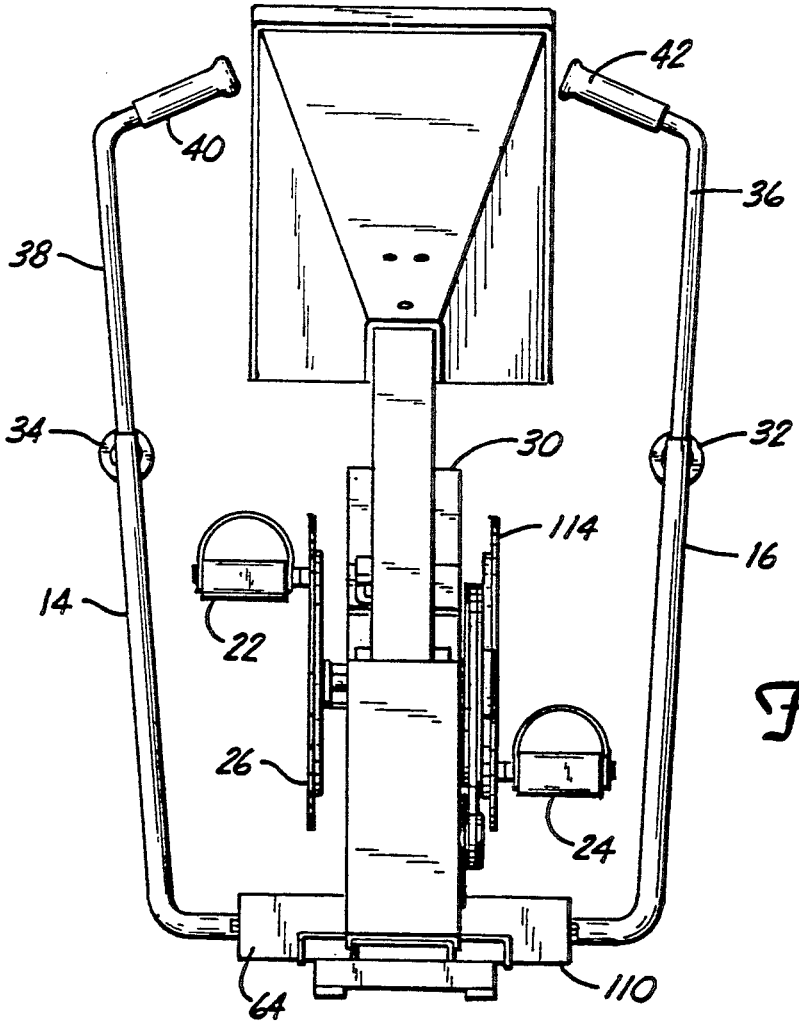
FIG. 4 is a front view of the exercise machine of the present invention.

FIG. 4 is a front view of the frame and the cycling movement of the present invention. Left exercise arm 16 is disposed on fulcrum 110 and exercise arm 14 on fulcrum 64. As may be seen with reference to FIGS. 3 and 4, exercise arms 14 and 16 are coaxial and provide for rowing action in parallel planes.

Figure 5:
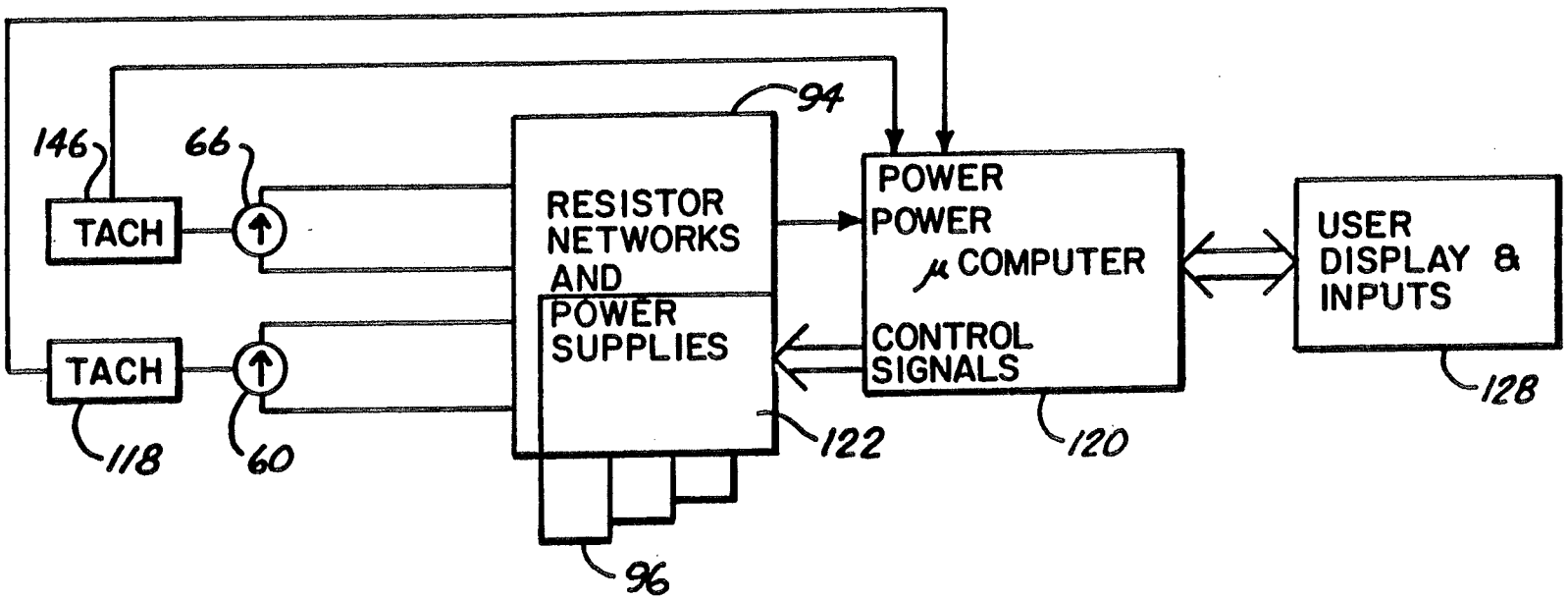
FIG. 5 is a schematic of the control and load circuitry of the present invention.

FIG. 5 illustrates the load distribution system of the present invention in schematic representation. DC generators 60 and 66 are coupled to tachometers 118 and 116 respectively. Measurements therefrom are transmitted to a microcomputer 120 housed in display panel 28. DC generators 60 and 66 are connected across a variable resistor pack 94 which applies selected loads independently to generators 60 and 66 at the direction of microcomputer 120. Heat produced in variable resistor pack 94 is dissipated through a heat sink 96. Microcomputer 120 provides control signals to variable resistor pack 94 to vary the instantaneous resistance shown in generators 60 and 66. Resistances may be varied to determine the total load and the variability of the load to provide simulated terrain profiling. Microcomputer 120 is also coupled to generators 60 and 66 through a power supply 122 and derives all power for its operation by actuation of generators 60 and 66. This allows elimination of a battery from within the exercise device or for any need to connect the device to an external power source. Microcomputer 120 drives user display 28 and receives control inputs from display 28 to determine the program it will operate.

A person exercising on the exerciser of the present invention benefits from the improvements thereof in several respects. Where an objective of exercise is weight control or cardiac efficiency, the workload distribution system lowers the perceived effort, enabling the user to maintain the required exertion level for a longer time. Microcomputer 120 determines the exercise intensity level required, and sets the resistor values across the respective generators to elicit the intensity level and to distribute the load between upper body and lower body. Displays indicate to the user the load breakdown and whether the user is meeting the total output demanded. The user selects the most comfortable distribution of load. The lower perceived level of work contributes to regular use of the machine.

Recumbent saddle 18 allows exercisers to easily mount and dismount from exercise machine 10. Movement of either exercise arm provides indication and power to microcomputer to start and execute a startup program for use by the user if desired. After start-up, microcomputer 120 can be kept in operation by actuation of either the cycling action or the upper body action. The exerciser may select from ten effort levels and can allocate the proportion of the effort required for either lower or upper body from 0% to 100%. The duration of a bout is set by default at fifteen minutes. Readouts will indicate to the users various indicia of their workout level as well as their progress toward completion of the bout.

The electronically variable load also allows terrain simulation for the cycling portion of the exercise. This contributes to maintaining the interest of the user.

The exercise arms provide for independently selectable ranges of movement for each arm which has therapeutic value.

Because the machine is powered by effort of the individual, no battery or external power connection is needed.

Although the present invention has been described with reference to preferred embodiments, workers skilled in the art will recognize that changes may be made in form and detail without departing from the spirit and scope of the invention.

What is claimed is:

1. A physical exercising apparatus comprising:

a support frame;

an adjustable seat mounted on the frame;

a crankset supported on the frame for rotation;

first and second exercise arms supported with respect to the frame for reciprocating movement;

means for applying a first selected level of resistance to rotation of the crankset including: a first generator;

a gear train for coupling mechanical energy from the crankset to the first generator; and a first variable resistance load electrically connected across the first generator for dissipating electrical energy generated by the first generator;

means for applying a second selected level of resistance to movement of the first and second exercise arms including:

a second generator;

means for translating reciprocating action applied to either exercise arm to rotational movement to drive the second generator; and a second variable resistance load electrically connected across the second generator for dissipating electrical energy generated by the second generator; and means for measuring and displaying the work individually applied to the crankset and to the first and second exercise arms.

2. The apparatus as defined in claim 1, wherein the adjustable seat further comprises:

a track supported by the frame;

a carriage mounted in the track and adapted to move along the track;

a recumbent saddle supported by the carriage; and the track being disposed on the frame such that movement of the carriage repositions the recumbent saddle along a line perpendicular to the axis of rotation of the pair of pedals.

3. The apparatus as defined in claim 1, wherein the means for measuring and displaying the work applied to crankset and to the exercise arms further comprises:

a microcomputer for determining the load applied to the first and second generators;

tachometers for generating signals indicating the rate at which the first and second generators are turning;

the microcomputer determining work applied to the crankset and to the exercise arms from the tachometer generated signals and the loads applied to the generators; and, a control and display panel for displaying work output.

4. The apparatus as defined in claim 3, wherein the first variable resistance load is responsive to a first control signal from the microcomputer for varying the load applied to the first generator.

5. The apparatus as defined in claim 4, wherein the second variable resistance load is responsible to a second control signal for varying the load applied to the second generator.

6. The apparatus as defined in claim 5 and further including:

the control and display panel being interfaced with the microcomputer;

the microcomputer being responsive to a plurality of operator inputs to execute a program which determined the values of the first control signal for simulating terrain profiling and the second control signal for varying the resistance applied to translation of the exercise arms.

7. The apparatus as defined in claim 6, further comprising a power supply and regulator for the microcomputer which is energized by applying mechanical energy to the crankset or to the exercise arms to produce electrical energy from the first or second generators.

8. The apparatus as defined in claim 7, wherein the adjustable seat includes a recumbent saddle.

9. A physical exercising apparatus including:

a support frame;

a position adjustable seat attached to the left frame;

a left exercise arm and a right exercise arm attached to the frame on opposite sides of the adjustable seat;

means linking the left exercise arm to a left carrier body and the right exercise arm to a right carrier body;

each carrier body supporting a primary wheel cluster and a complementary wheel cluster;

first and second wheel means supported for rotation at spaced locations on the frame;

left belt means training the first and second wheel means defining a primary lead of the left belt means between the first wheel means and the second wheel means and further defining a parallel complementary lead of the belt means between the second wheel means and the first wheel means;

right belt means training the first and second wheel means defining a primary lead of the left belt means between the first wheel means and the second wheel means and further defining a parallel complementary lead of the belt means between the second wheel means and the first wheel means;

each primary wheel cluster including a plurality of wheels, each wheel cluster being supported by its respective carrier body with its wheels in contact with the respective belt means along the primary lead of the belt means, the wheels of each primary cluster being adapted to free wheel against a belt means when the velocity of a primary cluster relative to the velocity of the belt means in the primary lead is negative and at least one of the wheels of each primary cluster being adapted to clutch with its respective belt means otherwise;

each complementary wheel cluster including a plurality of wheels, each wheel cluster being supported by its respective carrier body with its wheels in contact with its respective belt means along the complementary lead of the belt means, the wheels of each complementary cluster being adapted to free wheel against a belt means when the velocity of a complementary cluster relative to the velocity of the belt means in the complementary lead is negative and at least one of the wheels of each complementary cluster being adapted to clutch with its respective belt means otherwise;

the carrier body adapted to be moved by actuation of the exercise arms in reciprocating fashion along the complementary and primary leads of the belt means between the first and second wheel means;

an electrical generator;

a gear train coupling mechanical energy to the generator from the second wheel means; and variable resistance means is connected as a load across the electrical generator.

10. The apparatus as defined in claim 9, further comprising means for controlling the variable resistance means to vary the resistance of the load connected across the electrical generator.

11. The apparatus as defined in claim 10, further comprising:

left and right fulcrums mounted on the frame; and levers pivotally mounted on each fulcrum, the left lever including the left exercise arm as one lever arm and a second lever arm attached to the left carrier body, and the right lever including the right exercise arm as one lever arm and a second lever arm attached to the right carrier body;

whereby applying reciprocating action to an exercise arm results in reciprocating movement being applied to its respective carrier body.

12. A stationary, upper and lower body exercise device comprising:

a support frame an adjustable seat mounted on the frame;

a crankset including pedals supported on the frame for rotation;

first and second movable exercise arms mounted on the frame;

means for converting movement of the exercise arms to rotational motion;

a generator energized by movement of the crankset;

a generator energized by movement of the first or second exercise arms;

a control and display panel;

a microcomputer for accepting operator inputs to the control and display panel and for displaying data on the control and display panel;

a power dissipation board controllable by control signal for dissipating energy generated by the generators, thereby providing a load on the generators; and the microcomputer providing the control signal for controlling the load applied to the generators and determining the energy dissipated for display.

13. The stationary, upper and lower body exercise device defined in claim 12 wherein the adjustable seat further comprises:

a track supported by the frame;

a carriage mounted in the track and adapted to move along the track;

a recumbent saddle supported by the carriage; and the track being disposed on the frame such that movement of the carriage repositions the recumbent saddle along a line perpendicular to the axis of rotation of the crankset.

* * * * *

UNITED STATES PATENT AND TRADEMARK OFFICE

CERTIFICATE OF CORRECTION

PATENT NO. : 5,114,391

DATED : May 19, 1992

INVENTOR(S) : GERALD PITZEN, DOUGLAS GARFIELD, WARREN G. BELTZ, LAWRENCE O. ARNTZEN, JOSEPH C. BINA

It is certified that error appears in the above-identified patent and that said Letters Patent is hereby corrected as shown below:

Col. 8, line 17, delete "responsible", insert "responsive"

Signed and Sealed this

Sixth Day of July, 1993

Michael K. Kirk

MICHAEL K. KIRK

*Acting Commissioner of Patents and Trademarks*

*Attest:*

*Attesting Officer*